US006422047B1

(12) United States Patent
Magilton

(10) Patent No.: US 6,422,047 B1
(45) Date of Patent: Jul. 23, 2002

(54) WASHING MACHINE WITH UNBALANCE DETECTION AND CONTROL SYSTEM

(75) Inventor: Thomas C. Magilton, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/564,023

(22) Filed: May 4, 2000

(51) Int. Cl.[7] ..... D06F 33/02
(52) U.S. Cl. ..... 68/12.06; 68/23.3; 68/12.04
(58) Field of Search ..... 68/12.02, 12.04, 68/12.06, 23.1, 23.2, 23.3, 23.4; 210/144; 73/650

(56) References Cited

U.S. PATENT DOCUMENTS 2,807,950 A * 10/1957 Gerhardt et al.
2,892,152 A * 5/1959 Buisson
2,890,580 A * 6/1959 Etherington
2,911,812 A 11/1959 Metzger
2,917,175 A 12/1959 Toma
3,014,590 A 12/1961 Metzger
3,014,591 A 12/1961 Stone et al.
3,051,313 A 8/1962 Stelli
3,055,203 A 9/1962 Toma
3,084,799 A 4/1963 Decatur
3,145,818 A 8/1964 Stelli
3,152,462 A * 10/1964 Elliott et al.
3,172,848 A * 3/1965 Worst
3,209,561 A 10/1965 Burdett
3,226,016 A 12/1965 Couper et al.
3,311,237 A 3/1967 Bergeson et al.
3,318,118 A * 5/1967 Ohlson
3,339,732 A 9/1967 Bergman
3,402,819 A 9/1968 Mellinger
3,422,957 A 1/1969 Fosler
3,425,559 A 2/1969 Sisson
3,499,534 A 3/1970 Holzer
3,504,777 A 4/1970 Waugh
3,583,182 A 6/1971 Matsuura et al.
3,803,881 A 4/1974 Getz et al.
3,945,921 A 3/1976 Toth
4,096,988 A * 6/1978 Scuricini (List continued on next page.)

FOREIGN PATENT DOCUMENTS

JP 54-147663 * 11/1979 ..... 68/12.06
JP 8-206855 * 8/1996

*Primary Examiner*—Frankie L. Stinson
(74) *Attorney, Agent, or Firm*—Diederiks & Whitelaw, PLC

(57) ABSTRACT

A washing machine is provided with an unbalance detecting and control system which can sense an out-of-balance condition in five distinct directions extending within substantially three perpendicular planes. A single switch is utilized in connection with a switch actuator to sense an unbalance condition and to signal a controller for altering an operating condition of the washing machine. Particularly, the switch actuator is biased into engagement with a plunger of the switch and is caused to permit the plunger to extend when an unbalance condition arises.

15 Claims, 4 Drawing Sheets

U.S. PATENT DOCUMENTS 4,098,098 A 7/1978 Altnau
4,099,667 A 7/1978 Uchida
4,195,500 A 4/1980 Tobita et al.
4,411,664 A 10/1983 Rickard et al.
4,449,383 A 5/1984 Cartier
4,458,536 A * 7/1984 Ahn et al.
4,765,161 A 8/1988 Williamson
4,910,502 A 3/1990 Serveau et al.
5,152,159 A * 10/1992 Kabeya et al. ..... 68/12.02
5,269,159 A * 12/1993 Oh ..... 68/12.06
5,375,282 A 12/1994 Dausch et al.
5,375,437 A 12/1994 Dausch et al.
5,397,949 A * 3/1995 Guardiani et al.
5,523,644 A * 6/1996 Witehira
5,561,990 A * 10/1996 Berkcan et al.
5,561,993 A 10/1996 Elgersma et al.
5,606,877 A * 3/1997 Hashimoto ..... 68/12.12
5,661,990 A 9/1997 Chong
5,685,038 A 11/1997 Smith et al.
5,713,221 A * 2/1998 Myers et al.
5,850,746 A * 12/1998 Lee ..... 68/12.06
5,924,312 A * 7/1999 Vande Haar
5,974,839 A 11/1999 Johnson et al.
6,032,531 A * 3/2000 Roszhart
6,065,170 A * 5/2000 Jang ..... 68/12.06
6,282,956 B1 * 9/2001 Okada
6,292,966 B1 * 9/2001 Lim et al.

* cited by examiner

WASHING MACHINE WITH UNBALANCE DETECTION AND CONTROL SYSTEM

BACKGROUND OF THE INVENTION

1. Field of the Invention

The present invention pertains to the art of washing machines and, more particularly, to an unbalance detection and control system for a washing machine.

2. Discussion of the Prior Art

During operation of a washing machine, it is not uncommon for a tub or spinner of the machine to become unbalanced due to the particular distribution of a load of clothes therein. When the tub is rotated at a relatively high speed during an extraction phase of an overall washing cycle, an unbalanced condition can cause considerable vibrations of the entire machine. Since excessive vibrations can be detrimental to the continued reliability of the machine, it is known in the art to provide a vibration detection system for sensing an actual or incipient unbalance condition and for altering the operation of the machine when a predetermined threshold is reached. Typically, known systems function to either reduce the rotational speed of the clothes tub or entirely shut down the machine to counteract an unbalance condition.

In the art, various different vibration detection systems have been employed. For instance, it has been known to employ switches, such as mercury or micro switches, which are engaged when excessive vibrations are encountered. Activation of these switches is relayed to a controller for altering the operational state of the machine. Other known systems provide rather complicated electronic sensing systems to perform a corresponding function. In any event, the prior devices are designed to sense vibrations in only a limited number of planes or directions. More specifically, these known arrangements sense vibrations in either one or two planes. Therefore, at best, these unbalance detection systems are only designed to determine excessive vibrations in a maximum of four directions.

Sometimes it would be beneficial to sense an unbalance condition in at least one additional plane or direction. Expanding the planes or directions can be particularly important in connection with horizontal axis washing machine arrangements. That is, known unbalance sensing systems utilized in horizontal axis washing machines sense excessive vibrations in generally only vertical and/or horizontal planes. However, it has been found that a potentially damaging condition can be created based on excessive fore-to-aft movements of the spinner. Therefore, there exists a need in the art for an unbalance detection system for a washing machine, particularly a horizontal axis washing machine, which can sense an unbalance condition in three, substantially perpendicular planes and at least five directions. Furthermore, there exists a need for an improved unbalance detection system which is simple in construction and operation, so as to be reliable and cost effective.

SUMMARY OF THE INVENTION

A washing machine constructed in accordance with the present invention incorporates a system for controlling either an actual or incipient unbalance condition in a reliable, accurate and cost effective manner. More specifically, the present invention is directed to an unbalance detection system for a washing machine, particularly a horizontal axis washing machine, which can sense excessive vibrations in at least five directions, along three substantially perpendicular axes.

In accordance with the invention, the unbalance detection system preferably incorporates a single switch, the position of which can be altered based on excessive vibrations in any one of multiple planes or directions. In the most preferred form of the invention, a switch is fixedly secured relative to a cabinet portion of the machine and has an associated actuator which is attached to a mounting support through a plurality of springs. The springs tend to position the actuator in a neutral condition which is reflective of a balanced operation state for the machine.

The actuator also includes a shank portion arranged proximate a component of the machine which would tend to vibrate excessively during an unbalanced operating condition. In the preferred embodiment, the shank portion extends through a bore formed in a bracket element provided on a counterbalance weight unit attached to an outer tub of the washing machine. Since the shank portion extends through the bore, it is surrounded by the bracket element and therefore can be engaged upon any excessive movements of the outer tub in various directions. In a horizontal axis washing machine, these directions include up, down and side-to-side movements of the outer tub. In addition, the shank portion preferably carries at least one cross pin which can be engaged to further shift the actuator upon excessive unbalance movement in a generally fore-to-aft direction. Once an unbalance condition is sensed, a signal is relayed to a controller for altering the operation of the machine to counteract system imbalances.

Based on the above, it should be readily apparent that the invention provides for a relatively simple, inexpensive unbalance detection assembly which is sensitive to out-of-balance conditions in a multitude of directions and planes. In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF A PREFERRED EMBODIMENT

Figure 1:
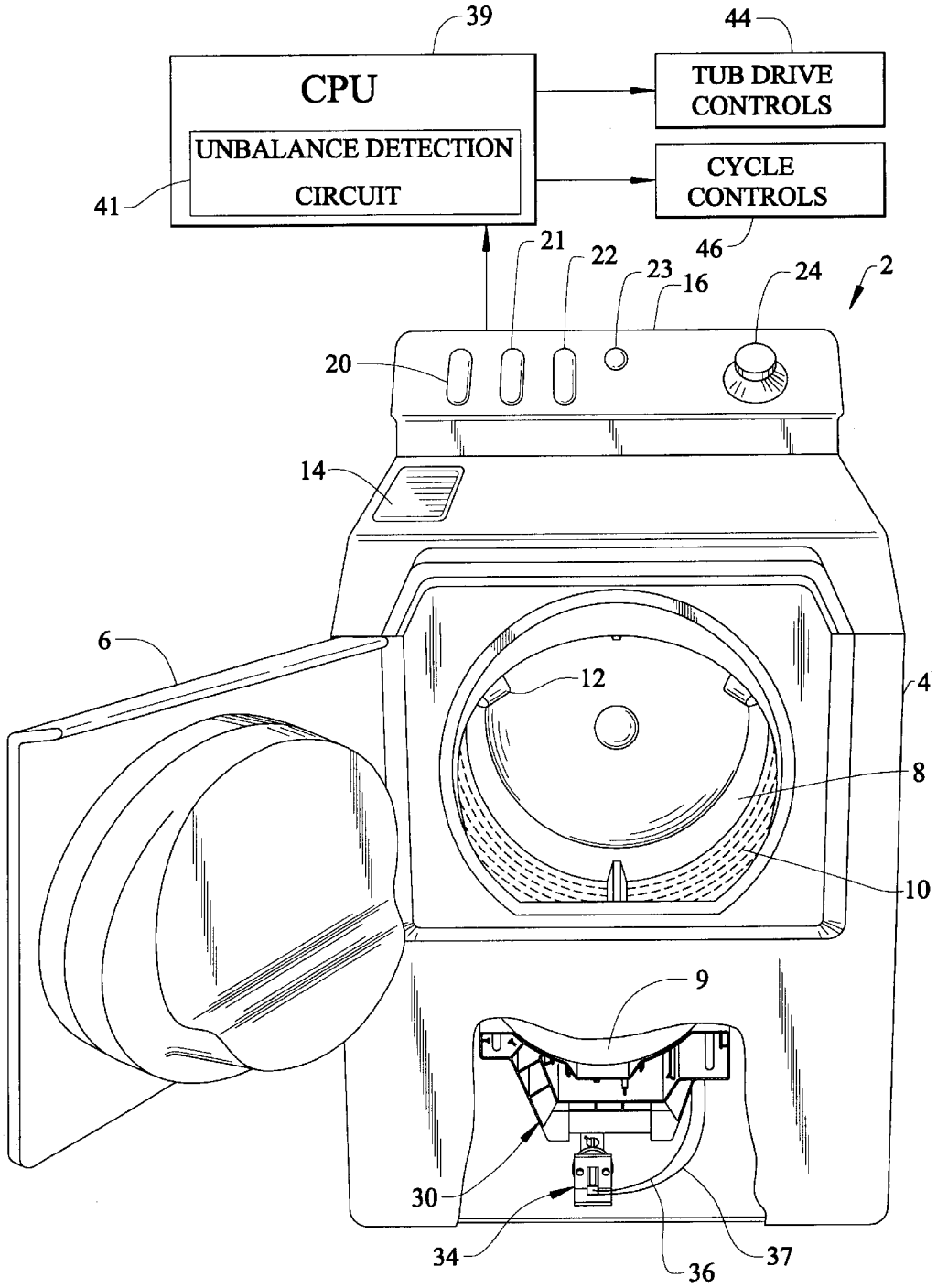
FIG. 1 is a partially exploded, front perspective view of a washing machine incorporating an unbalance detection system according to the invention.

The unbalance detection and control system of the invention will now be described for use in connection with a clothes washing machine generally shown at 2 in FIG. 1. As shown in FIG. 1, washing machine 2 constitutes a horizontal axis machine including an outer cabinet shell 4 having an associated door 6 which can be selectively opened to expose a washing basket 8. In the embodiment shown, washing basket 8, also referred to as an inner tub or spinner, is mounted within an outer tub 9 in outer cabinet shell 4 for rotation about an axis which is angled slightly downward and rearward. For the sake of completeness, washing basket 8 is shown to include a plurality of holes 10, as well as various annularly shaped and radially inwardly projecting fins or blades 12 which are fixedly secured to washing basket 8. In the manner known in the art, washing basket 8 is adapted to rotate during both wash and rinse cycles, such that articles of clothing placed therein actually tumble through either a water/detergent solution or water supplied within washing basket 8. Water for the selected operation is actually contained within outer tub 9 in a manner known in the art. For the sake of completeness, washing machine 2 is also shown to include an upper cover 14 for providing access to an area for adding detergent, softener and the like.

Washing machine 2 is shown to incorporate an upper control panel 16. In the preferred embodiment shown, control panel 16 includes a plurality of cycle setting buttons 20–22, a start/stop button 23 and a rotary control knob 24. Buttons 20–22 and control knob 24 are utilized to establish a desired washing operation. Since the general setting and operating of washing machine 2 is known in the art and does not form part of the present invention, these features will not be discussed here in detail. However, in general, buttons 20–22 are used to manually set desired operational parameters, including a desired fill level based on load size, wash and rinse temperatures, along with the type of washing operation, such as gentle, normal or the like cycles, typically based on the particular fabrics being washed. On the other hand, control knob 24 is used to set the type and duration of the washing operation. Although the control panel 16 is shown to include buttons 20–23 and control knob 24, it should be understood that these particular types of control elements are merely intended to be exemplary and that other types of control elements, including electronic control elements and the like could be readily utilized.

Secured to outer tub 9, as clearly shown in FIG. 1, is a counterbalance weight unit 30. In general, such a counterbalance weight unit is known in the art and disclosed in U.S. Pat. No. 5,974,839 which is incorporated herein by reference. Associated with counterbalance weight unit 30 is an unbalanced detecting unit 34 constructed in accordance with the present invention. As will be detailed more fully below, detecting unit 34 is linked through a pair of wires 36 and 37 to a control unit or CPU 39. Incorporated in control unit 39 is an unbalance detection circuit generally indicated at 41. Unbalance detection circuit 41 receives signals from unbalance detecting unit 34 and, depending on these signals, alterations can be made to either tub drive controls 44 and/or cycle controls 46 associated with washing machine 2 as will be discussed further below.

Figure 2:
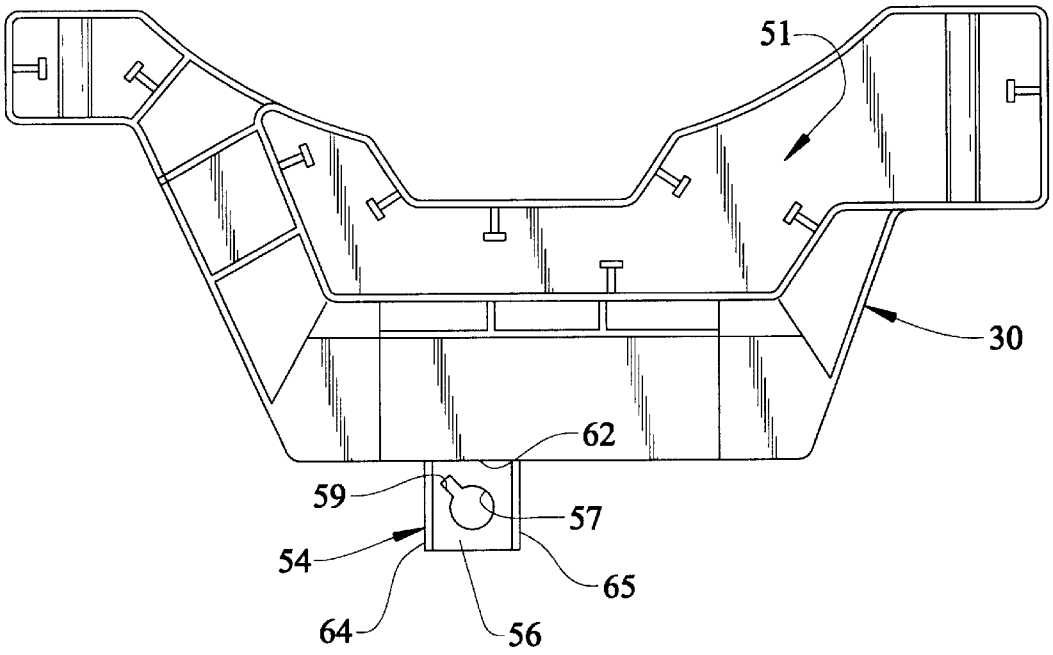
FIG. 2 is a front elevational view of a counterbalance weight unit for a horizontal axis washing machine as modified in accordance with the invention.
Figure 3:
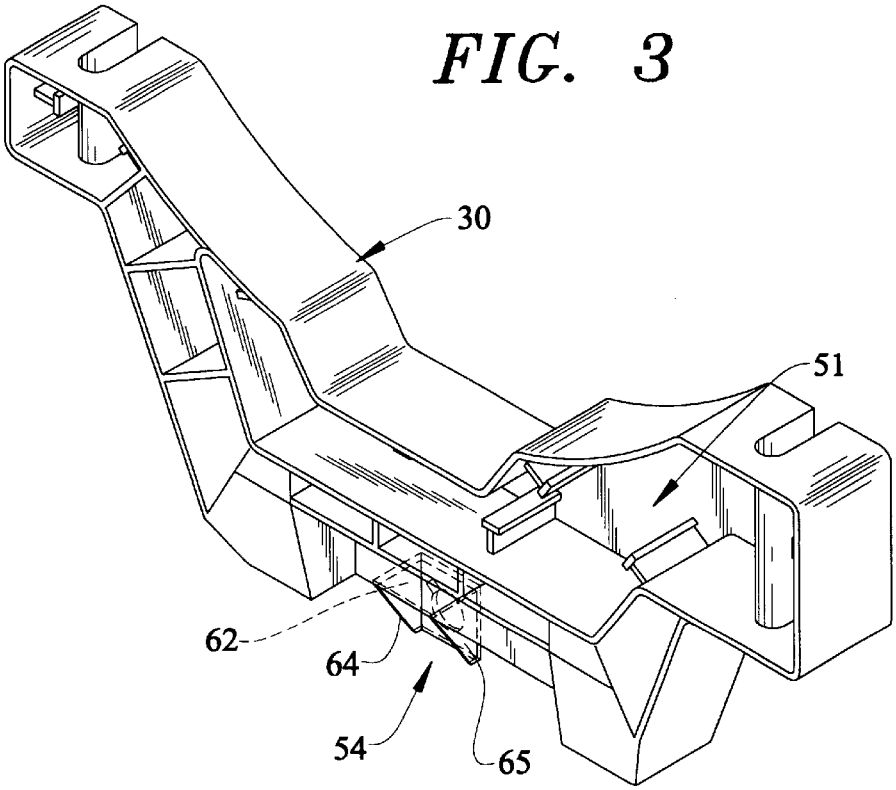
FIG. 3 is an upper right perspective view of the modified counterbalance weight unit of FIG. 2.
Figure 4:
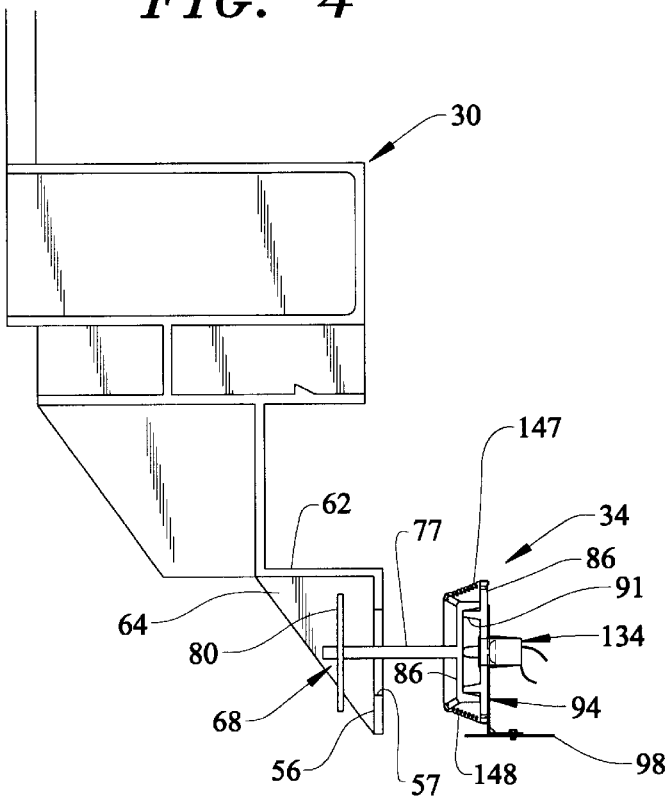
FIG. 4 is a side view of a portion of the counterbalance weight unit shown with an overall unbalance detecting or sensing assembly provided in accordance with the invention.

As best shown in FIGS. 2–4 and described in the '839 patent, counterbalance weight unit 30 includes a zone 51 which is adapted to receive counterweights (not shown) used in balancing of washing machine 2. In accordance with the present invention, counterbalance weight unit 30 incorporates an actuating bracket 54 which preferably projects downward from counterbalance weight unit 30. In the most preferred form of the invention, actuating bracket 54 is integrally molded with counterbalance weight unit 30. However, actuating bracket 54 could be formed as an individual component and fixedly secured to counterbalance weight unit 30 or, as will become clear hereafter, another component of washing machine 2 which would tend to excessively vibrate when an unbalance condition exists. In any event, actuating bracket 54 preferably includes an upstanding wall 56 which is provided with an aperture 57. Aperture 57 also has associated therewith a key slot 59. Actuating bracket 54 also includes an upper wall 62 and a pair of gussetts or side walls 64 and 65.

Figure 5:
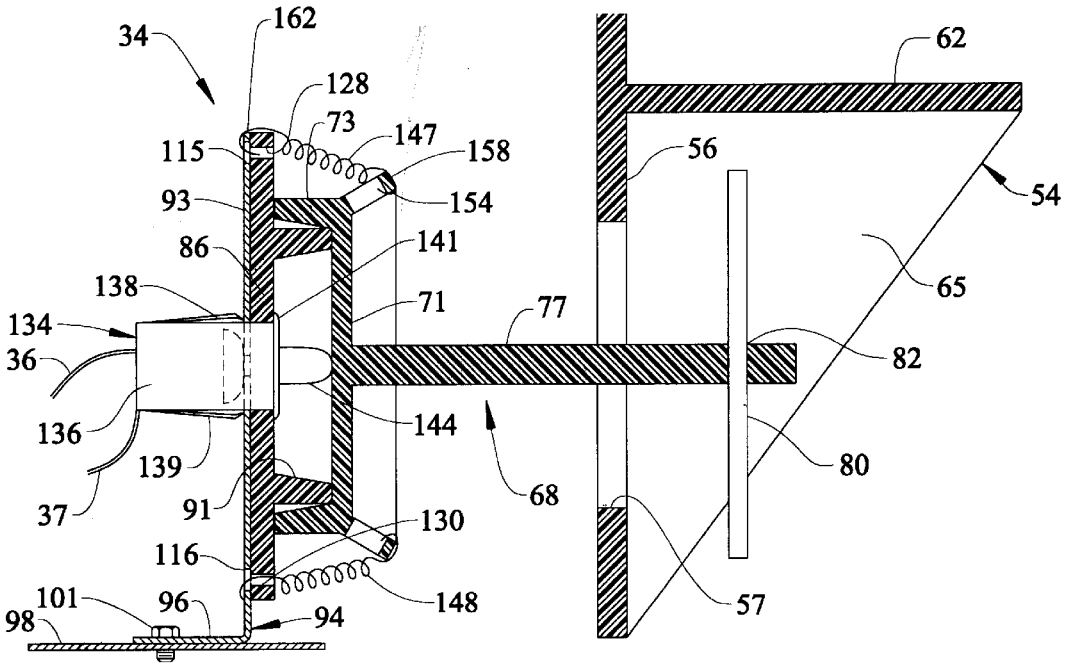
FIG. 5 is an enlarged, partially cross-sectional view of the detecting assembly of FIG. 4.

With particular reference to FIGS. 4 and 5, unbalance detecting unit 34 includes a switch actuator generally indicated at 68. In the most preferred form of the invention, switch actuator 68 includes a base 71 provided with an outermost, annular flange portion 73. Extending from base 71, in a direction generally opposite to flange portion 73, is a shank 77 of switch actuator 68. As clearly shown in these figures, shank 77 projects through aperture 57 of actuating bracket 54. More particularly, an end portion of shank 77, remote from base 71, is provided with a cross pin 80 which projects through a bore 82 formed in shank 77. Pin 80 has an associated length which is greater than the combination of the diameter of aperture 57 and the length of key slot 59. However, essentially half of pin 80 can be positioned within aperture 57 and then shank 77 can be pivoted to enable the remainder of pin 80 to be received within key slot 59 such that pin 80 can extend through upstanding wall 56 of actuating bracket 54 as shown in these figures.

Figure 7:
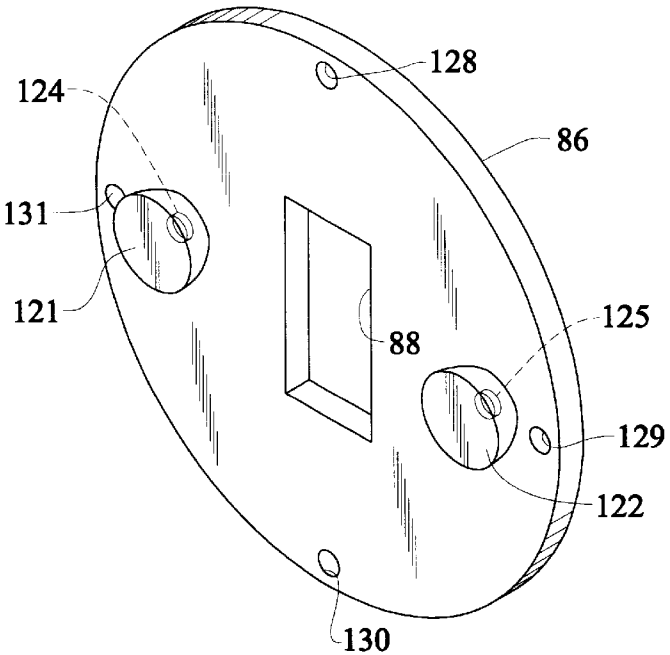
FIG. 7 is a perspective view of a mounting plate used in combination with the mounting bracket shown in FIG. 6.
Figure 6:
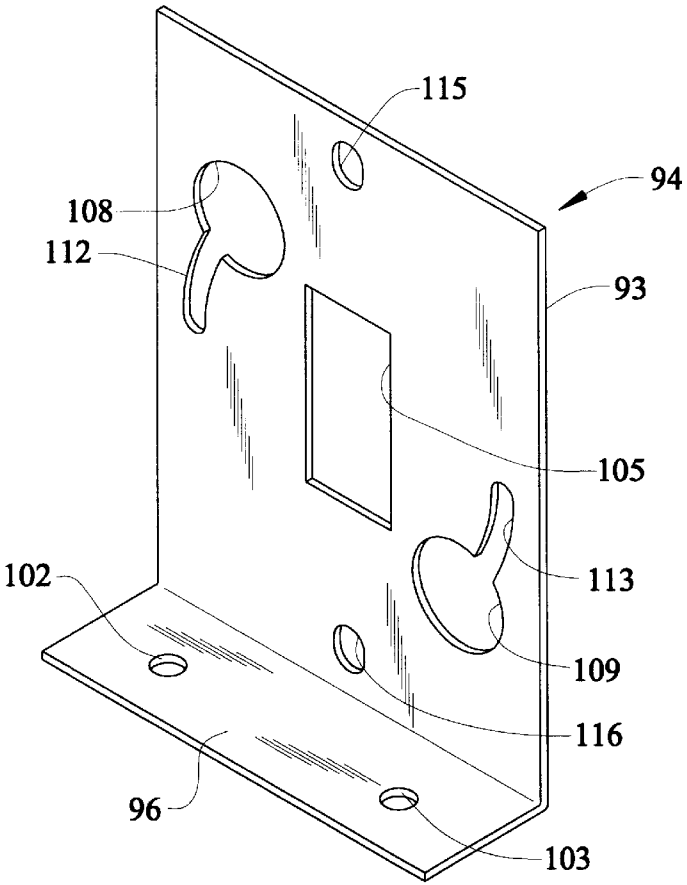
FIG. 6 is a perspective view of a bracket used in mounting a switch and actuator incorporated in the detecting assembly.

Switch actuator 68 also includes a mounting support 86 which is provided with a central opening 88 (also see FIG. 7). Although central opening 88 can take various geometric forms, a rectangular configuration is utilized in accordance with the preferred embodiment of the invention. Mounting support 86 is also provided with an inner annular projection 91 as clearly shown in FIGS. 4 and 5. Mounting bracket 86 is secured to a first leg 93 of a L-shaped bracket 94. L-shaped bracket 94 includes a second leg 96 that is fixed to a plate 98 by means of a plurality of fasteners, one of which is indicated at 101. More specifically, L-shaped bracket 94 includes a pair of spaced holes 102 and 103 (see FIG. 6) through which fasteners 101 extend into plate 98. L-shaped bracket 94 also includes a central hole 105 which substantially corresponds to the shape of central opening 88. Furthermore, spaced from central hole 105 is provided a pair of eyelets 108 and 109, each of which includes an associated arcuate slot 112 and 113 respectively. Finally, first leg 93 of L-shaped bracket 94 also preferably includes upper and lower through holes 115 and 116.

On a side opposite inner annular projection 91, mounting support 86 preferably has extending therefrom a pair of bosses 121 and 122. Bosses 121 and 122 are spaced from the plane of mounting support 86 by respective stems 124 and 125. As will become clear below, stems 124 and 125 have associated lengths which are slightly greater than the thickness of first leg 93 of L-shaped bracket 94. As also clearly shown in FIG. 7, mounting support 86 is also formed with outer, circumferentially spaced openings 128–131.

Detecting unit 34 also includes a switch 134 having an associated body or housing 136. Body 136 is provided with a pair of opposing, flexible tabs or fingers 138 and 139, as well as a diametric enlarged terminal flange 141. Furthermore, switch 134 includes a plunger 144 which is adapted to shift into and out of body 136. As will be discussed more fully below, plunger 144 is adapted to be shifted into body 136 by engagement with base 71 of switch actuator 68 as best shown in FIG. 5. However, plunger 144 is preferably biased out of body 136 by a spring not shown) such that, upon extension of plunger 144, a signal is sent through wires 36 and 37 to unbalance detection circuit 41 of control unit 39.

Prior to further detailing the operation of the unbalance detection and control system of the present invention, the manner in which unbalance detecting unit 34 is assembled will now be described. As indicated above, L-shaped bracket 94 is fixedly secured to plate 98 which, in turn, is fixed relative to cabinet 4. Mounting support 86 can then be secured to bracket 94 by positioning bosses 121 and 122 within eyelets 108 and 109 and thereafter rotating mounting support 86 such that stems 124 and 125 slide within arcuate radial slots 112 and 113. Mounting support 86 is rotated until central opening 88 is aligned with central hole 105. At this point, body 136 of switch 134 is pushed through central opening 88 and central hole 105, with flexible fingers 138 and 139 deflecting inward until fingers 138 and 139 extending beyond first leg 93 of L-shaped bracket 94. At this point, fingers 138 and 139 inherently flex outward to maintain, in combination with terminal flange 141 abutting mounting support 86, switch 134 in the desired position shown in FIGS. 4 and 5. With this construction, switch 134 is generally snap-fit into position. Body 136 of switch 134 preferably has a shape that conforms to each of central opening 88 and central hole 105 such that relative rotation between mounting support 86 and L-shaped bracket 94 is prevented.

When arranged in this manner, openings 128 and 130 are aligned with holes 115 and 116 respectively.

At this point, it should be understood that wires 36 and 37 can either be subsequently attached to body 136 or wires 36 and 37 can extend out from within body 136 and be initially fed through central opening 88 and central hole 105 upon mounting of switch 134. In any event, wires 36 and 37 are routed to control unit 39 as discussed above. In essence, switch 134 constitutes a plunger-type switch unit of the type known in the marketplace wherein the extension of plunger 144 away from body 136 causes a circuit to be open across wires 36 and 37.

After attaching mounting support 86 to L-shaped bracket 94 and mounting of switch 134 in the manner described above, shank 77 of switch actuator 68 is placed through aperture 57 with pin 80 extending through key slot 59 as discussed above. Thereafter, base 71 is positioned against inner annular projection 91, with annular flange 73 extending around projection 91. When flange 73 is arranged against mounting support 86, base 71 of switch actuator 68 abuts and depresses plunger 144 of switch 134. A plurality of springs, two of which are shown at 147 and 148 even though four are actually provided in the preferred embodiment, are then used to interconnect switch actuator 68 to mounting support 86 and first leg 93 of L-shaped bracket 94. More specifically, each spring 147, 148 has a first associated end 154 that extends about a mounting eyelet 158 provided on a circumferential portion of base 71. In addition, each spring 147, 148 has a second end 162 that is attached at a respective one of the openings 128-131 formed in mounting support 86. In the most preferred form, mounting support 86 is wider than first leg 93 of L-shaped bracket 94 such that openings 129 and 131 project beyond first leg 93. Therefore, second end 162 of each remaining spring is directly connected solely to mounting support 86 at respective openings 129 and 131. On the other hand, second end 162 of each spring 147 and 148 are not only attached at openings 128 and 130 but also at holes 115 and 116 of L-shaped bracket 94.

Excessive vibrations of washing machine 2 will result in shifting of counterbalance weight unit 30 relative to cabinet shell 4. Plate 98 is fixed relative to cabinet shell 4 such that counterbalance weight 30 will shift relative to mounting support 86 and switch 134. Upon reaching a state wherein an excessive unbalance condition exists, a portion of actuating bracket 54 will abut shank 77 and/or pin 80 of switch actuator 86. Although switch actuator 68 is biased into a neutral or machine balanced position by the mounting thereof through springs 147, 148, switch actuator 68 will shift when engaged by actuating bracket 54. Excessive shifting of switch actuator 68 will cause a predetermined degree of extension of plunger 144 which, in turn, will signal circuit 41 that an unbalance condition exists. In accordance with the invention, the presence of an unbalance condition is counteracted by reducing the rate at which basket 8 is being driven through tub drive controls 44 and/or altering the preset operating cycle of washing machine 2 through cycle controls 46. For instance, if an unbalance condition is detected during an extraction phase of washing machine 2, the rotational speed imparted to basket 6 can be initially reduced. If this alteration does not alleviate the excessive unbalance condition, the operating cycle of washing machine 2 can be terminated through cycle controls 46.

Due to the construction of unbalance detecting unit 34, unbalance conditions in at least five directions or three substantially perpendicular planes can be sensed and counteracted. More specifically, with particular reference to FIGS. 4 and 5, switch actuator 68 can be abutted by actuating bracket 54 by excessive movements of actuating bracket 54 in the up, down, left (out of page), right (into page) or fore-to-aft directions. That is, upon excessive vertical vibrations associated with washing machine 2, actuating bracket 54 will abut shank 77 from below to cause a general pivoting of switch actuator 68. Excessive downward movement of actuating bracket 54 will result in a corresponding, opposing movement of switch actuator 68. Similar abutments occur with actuating bracket moving to the right or left. Finally, rearward shifting of outer tub 9 relative to cabinet 4 due to an excessive unbalance condition will result in actuating bracket 54 abutting pin 80 which will also cause base 71 to shift away from body 136 of switch 134 such that plunger 144 assumes an extended, unbalance condition identifying position.

Based on the above, it should be readily apparent that the unbalance detection and control system of the present invention utilizes a single switch 134 and a single switch actuator 68 to sense unbalance conditions in at least five directions and three, substantially perpendicular planes. The sensitivity of the overall system can be readily varied by adjusting the tensions on springs 147, 148 and/or repositioning of pin 80 closer or further away from upstanding wall 56 of actuating bracket 54. If back-to-fore movements of outer tub 9 are of concern, an additional pin, similar to that of pin 80, can extend through a further aperture (not shown) provided in shank 77 on a side of upstanding wall 56 opposite pin 80. In any event, although a preferred embodiment of the invention has been described, it should be understood that various changes and/or modifications can be made to the invention without departing from the spirit thereof. Instead, the invention is only intended to be limited by the scope of the following claims:

I claim:

1. A washing machine comprising:

a cabinet shell;

an outer tub mounted within the cabinet shell;

an inner tub mounted within the outer tub for rotation during predetermined intervals in an overall washing operation; and means for detecting an unbalance condition of the outer tub in three, substantially perpendicular planes, wherein the detecting means includes a switch fixed relative to the cabinet shell and a switch actuator adapted to be shifted upon reaching the unbalance condition.

2. The washing machine according to claim 1, further comprising: a mounting support and a plurality of spring elements, said switch actuator being connected to the mounting support through the spring elements.

3. The washing machine according to claim 2, wherein said detecting means includes only a single said switch.

4. The washing machine according to claim 1, wherein said switch actuator includes a base, adapted to engage a member of the switch, and an elongated shank portion, said shank portion being adapted to be engaged by an element of the washing machine which shifts, from a steady state position, a predetermined amount during operation of the washing machine in an unbalance condition.

5. The washing machine according to claim 4, wherein the element of the washing machine constitutes a counterbalance weight unit.

6. The washing machine according to claim 4, wherein the element of the washing machine is formed with an aperture through which said shank portion projects.

7. The washing machine according to claim 4, further comprising: a mounting bracket and aligned holes provided in the mounting bracket and the base respectively, said switch being mounted in the aligned holes.

8. The washing machine according to claim 2, wherein said detecting means includes only a single switch.

9. A washing machine comprising:

a cabinet shell;

an outer tub mounted within the cabinet shell;

an inner tub mounted within the outer tub for rotation during predetermined intervals in an overall washing operation;

an unbalance detection assembly including a sensing switch and a switch actuator, said unbalance detection assembly sensing an out-of-balance condition of the washing machine in five distinct directions; and a mounting support and a plurality of spring elements, said switch actuator being connected to the mounting support through the spring elements.

10. The washing machine according to claim 9, wherein said detecting means includes only a single switch.

11. A washing machine comprising:

a cabinet shell;

an outer tub mounted within the cabinet shell;

an inner tub mounted within the outer tub for rotation during predetermined intervals in an overall washing operation; and an unbalance detection assembly including a sensing switch and a switch actuator, said unbalance detection assembly sensing an out-of-balance condition of the washing machine in five distinct directions, wherein said switch actuator includes a base, adapted to engage a member of the switch, and an elongated shank portion, said shank portion being adapted to be engaged by an element of the washing machine which shifts, from a steady state position, a predetermined amount during operation of the washing machine in an unbalance condition.

12. The washing machine according to claim 11, further comprising: a mounting support and a plurality of spring elements, said switch actuator being connected to the mounting support through the spring elements.

13. The washing machine according to claim 11, wherein the element of the washing machine constitutes a counterbalance weight unit.

14. The washing machine according to claim 11, wherein the element of the washing machine is formed with an aperture through which said shank portion projects.

15. The washing machine according to claim 11, further comprising: a mounting bracket and aligned holes provided in the mounting bracket and the base respectively, said switch member being mounted in the aligned apertures.

* * * * *